US012066184B2

(12) United States Patent
Dai et al.

(10) Patent No.: US 12,066,184 B2
(45) Date of Patent: Aug. 20, 2024

(54) LOW-NOx AIR HEATING SWIRL BURNER

(71) Applicant: ANDERSON THERMAL SOLUTIONS (SUZHOU) CO., LTD., Jiangsu (CN)

(72) Inventors: Senwei Dai, Jiangsu (CN); Renquan Sun, Jiangsu (CN); Zhuanbo Ren, Jiangsu (CN); Liangyan Sun, Jiangsu (CN); Hongxing Sun, Jiangsu (CN)

(73) Assignee: ANDERSON THERMAL SOLUTIONS (SUZHOU) CO., LTD., Jiangsu (CN)

( * ) Notice: Subject to any disclaimer, the term of this patent is extended or adjusted under 35 U.S.C. 154(b) by 498 days.

(21) Appl. No.: 17/427,007

(22) PCT Filed: Nov. 20, 2019

(86) PCT No.: PCT/CN2019/119665
§ 371 (c)(1),
(2) Date: Jul. 29, 2021

(87) PCT Pub. No.: WO2021/051635
PCT Pub. Date: Mar. 25, 2021

(65) Prior Publication Data

US 2022/0065444 A1 Mar. 3, 2022

(30) Foreign Application Priority Data

Sep. 18, 2019 (CN) ..... 201910884246.2
Sep. 18, 2019 (CN) ..... 201921556338.X

(51) Int. Cl.
*F23D 14/70* (2006.01)
*F23D 14/24* (2006.01)

(52) U.S. Cl.
CPC ..... *F23D 14/70* (2013.01); *F23D 14/24* (2013.01); *F23D 2900/14* (2013.01)

(58) Field of Classification Search
CPC ..... F23D 14/70; F23D 14/24; F23D 2900/14; F23D 14/46; F23D 11/38
(Continued)

(56) References Cited

U.S. PATENT DOCUMENTS 3,830,620 A * 8/1974 Martin ..... F23D 14/34 60/749

FOREIGN PATENT DOCUMENTS

BR 112015031702 B1 * 6/2013
CN 103776030 A 5/2014
(Continued)

*Primary Examiner* — Allen R. B. Schult
*Assistant Examiner* — William C Weinert
(74) *Attorney, Agent, or Firm* — Muncy, Geissler, Olds & Lowe, P.C.

(57) ABSTRACT

A low $NO_X$ air heating swirl burner includes at least one burner unit, the burner unit comprising a combustion air duct, a fuel gas supply pipeline, a combustion nozzle and a fire protection baffle. The fire protection baffle comprises a fin and a base plate for generating swirl combustion air. The base plate includes a plurality of elongated holes and air guide blades disposed obliquely on air outlet sides of the elongated holes. The combustion air flows out of the elongated holes in the base plate of the fire protection baffle, generates a rotational flow under the action of the air guide blades to be strongly mixed with fuel gas sprayed from the combustion nozzle for combustion. The burner is in a modular form, which can adopt a corresponding splicing shape according to structural features of a heating space to meet the heating requirement.

9 Claims, 7 Drawing Sheets

(58) Field of Classification Search
USPC ..... 431/8, 158, 123
See application file for complete search history.

(56) References Cited

FOREIGN PATENT DOCUMENTS

| | | | | | |
|---|---|---|---|---|---|
| CN | 204213926 | U | | 3/2015 | |
| CN | 205939145 | U | | 2/2017 | |
| CN | 107062226 | A | | 8/2017 | |
| CN | 107781808 | A | * | 3/2018 | ..... F23D 14/02 |
| CN | 208859606 | U | * | 5/2019 | ..... F23C 5/08 |
| CN | 208859606 | U | | 5/2019 | |
| CN | 111964054 | B | * | 1/2022 | ..... F23D 14/04 |
| KR | 20020007859 | A | * | 7/2000 | |
| KR | 200421615 | Y1 | * | 4/2006 | |
| WO | WO9509326 | A1 | | 4/1995 | |

* cited by examiner

LOW-NOx AIR HEATING SWIRL BURNER

TECHNICAL FIELD

The present disclosure relates to a field of burners, and particularly, to a low $NO_X$ air heating swirl burner.

BACKGROUND

The existing air heating burners generally equipped with combustion air fan, mix with process air to heat the process air after the combustion. However, on air duct plane section after burner, has ununiform temperature. In addition, the process air may also be directly used as the combustion air. When the process air is used for combustion, it is uneasy to complete the combustion, thus causing pollutions to the environment.

SUMMARY OF THE PRESENT DISCLOSURE

In order to overcome the above defects of the prior art, an objective of the present disclosure is to provide a low $NO_X$ air heating swirl burner with combustion air to support a combustion and a process air to participate in the combustion. The present disclosure is suitable for drying and heating with the medium-high temperature air in gypsum board manufacturing, etc.

In order to achieve the above objective, a technical solution adopted by the present disclosure to solve its technical problem is a low $NO_X$ air heating swirl burner comprising at least one burner unit, the burner unit comprising:

- a combustion air duct for providing combustion air and connected to a combustion fan through a duct;
- a fuel gas supply pipeline for supplying gaseous fuel;
- a combustion nozzle disposed at an air outlet of the combustion air duct and connected to the fuel gas supply pipeline;
- a fire protection baffle that covers the air outlet of the combustion air duct, and comprises a fin and a base plate for generating swirl combustion air; the combustion nozzle is mounted at a center of the base plate, and a gas outlet of the combustion nozzle is located on an air outlet side of the base plate; the base plate is provided with a plurality of elongated holes and air guide blades disposed obliquely on air outlet sides of the elongated holes; the plurality of elongated holes are distributed in a circumferential array by taking a center of the combustion nozzle as a circle center, and a length of each of the elongated holes is distributed in a radial direction or diagonally extended from an end near the circle center to an end away from the circle center; the fin is extended obliquely outward from an edge of the base plate in an outward expanding manner along an air outlet direction.

Compared with the prior art, in the present disclosure, the combustion air flows out of the elongated holes in the base plate of the fire protection baffle, generates a rotational flow under the action of the air guide blades to be strongly mixed with fuel gas sprayed from the combustion nozzle for combustion; a part of process air passes through the fin and participates in the combustion, which greatly improves the temperature uniformity on the whole section of the combustion air duct and greatly reduces the generation of nitrogen oxides, thus stably providing the heating process air with a uniform temperature below 850° C., and meeting the industrial technological requirements such as gypsum board drying. The burner is in a modular form, which can adopt a corresponding splicing shape according to structural features of a heating space so as to meet the heating requirement.

Further, the combustion nozzle comprises a nozzle, a cylindrical flame retaining cup, and a flame retaining cup base extended from an outer wall of the nozzle to an inner wall of the flame retaining cup.

According to the above preferred solution, the flame stability can be protected.

Further, the nozzle comprises a small hole-diameter portion at a head thereof end and a large hole-diameter portion communicated with the small hole-diameter portion; a diameter of a vent hole of the large hole-diameter portion is larger than that of a vent hole of the small hole-diameter portion; an end face of the head end of the nozzle is provided with a concave groove, and two side walls of the groove are along two parallel tangent lines of the vent hole of the small hole-diameter portion; and two ends of the groove are disposed to penetrate through an outer wall of the top of the nozzle.

According to the above preferred solution, an outer periphery of the large hole-diameter portion of the nozzle is provided with external threads for threaded-connection with the fuel gas supply pipeline; a small center hole in a head of the nozzle ensures that the fuel gas can be sprayed from the nozzle at a high speed; and the walls of the groove can protect the flame.

Further, the small hole-diameter portion of the nozzle is completely located on a flame generation side of the flame retaining cup base, and the large hole-diameter portion of the nozzle also has a part of primary structure located on the flame generation side of the flame retaining cup base; the flame retaining cup base is provided with a plurality of first through holes which are distributed in a circumferential array by taking a center of the nozzle as a circle center, and a pipe wall of the large hole-diameter portion located on the flame generation side of the flame retaining cup base is provided with a plurality of second through holes extended in a radial direction and of the same number as the first through holes; in each pair of the first through hole and the second through hole, an axis of the first through hole and a circle center of the second through hole are coincided on a projection plane along an axis direction of the nozzle.

According to the above preferred solution, the first through holes on the flame retaining cup base facilitate a part of combustion air to reach an inner side of the flame retaining cup, while the second through holes in the circumferential direction of the head of the nozzle facilitate the fuel gas to laterally overflow from the nozzle, and the part of combustion air is premixed with the overflowed fuel gas, thus improving the combustion sufficiency.

Further, the outer wall of the large hole-diameter portion of the nozzle is further provided with an outwardly extended induction ring body, which is located between the flame retaining cup base of the combustion nozzle and the base plate of the fire protection baffle, and is provided with an air guide slope that faces towards the first through hole.

According to the above preferred solution, the air guide slope improves the smoothness of guiding the combustion air to an inner side of the flame retaining cup, and the induction ring body can also play a limiting role when the combustion nozzle is mounted, thus ensuring an accurate mounting position of the combustion nozzle.

Further, a plurality of third through holes are disposed on the flame retaining cup; the number of the first through holes or the second through holes is 3 to 6, and the number of the third through holes is 3 to 12.

According to the above preferred solution, the third through holes facilitate the overflow of the mixture of the fuel gas and air in the flame retaining cup, thus transferring the flame and improving the flame stability.

Further, an included angle between the fin and the base plate of the fire protection baffle is 20° to 60°; a notch is formed at an outer edge of the fin, and an opening width of the notch gradually increases from an inner side to an outer side.

According to the above preferred solution, the process air can reach an inner side of the fin along the notch to support the flame and generate more uniform temperatures in the whole air duct plane.

Further, the number of the elongated holes in the base plate of the fire protection baffle is 4 to 12, and an inclined angle between the air guide blade and the base plate is 30° to 60°.

According to the above preferred solution, it is convenient to cause a strong rotation of the combustion air, enhance the mixing with the fuel gas, and shorten the flame.

Further, a flow equalization plate is disposed in the combustion air duct and provided with densely distributed small holes.

According to the above preferred solution, the flow equalization plate can equalize the combustion air from the air duct and uniformly distribute the combustion air to the space of each burner unit.

Further, the number of the burner units is greater than or equal to 2, and the fuel gas supply pipeline is distributed along connecting lines between centers of the combustion nozzles of the burner units; the fuel gas supply pipeline is provided with first fuel gas openings for mounting the combustion nozzles, and second fuel gas openings connected between the adjacent first fuel gas openings; a diameter of the first fuel gas opening is larger than that of the second fuel gas opening; the number of the second fuel gas openings distributed between adjacent two of the first fuel gas openings is 1 to 3; the diameter of the second fuel gas opening is 1 to 4 mm; the base plate of the fire protection baffle is provided with through holes for releasing fuel gas flowing from the second fuel gas openings.

According to the above preferred solution, the fuel gas reaches an inner side of the fire protection baffle through the second fuel gas openings, and is mixed with air to generate a flame, which is beneficial to the propagation of the flame among the burner units and causes the temperatures of the whole section of the hot air duct to be more uniform.

Further, the plurality of burner units are spliced into a grid, the fins of the fire protection baffles are distributed at edges of an outline of a base plate of the grid, and a distance between adjacent two of the fire protection baffles is 1.5 to 4 times a width of a single fire protection baffle.

According to the above preferred solution, the number of the burner units is reduced so that the layout of the burner units is more reasonable, and it is convenient to provide a large cross section of the hot air duct and hot air of uniform temperatures thereon.

BRIEF DESCRIPTION OF THE ACCOMPANYING DRAWINGS

In order to more clearly explain the embodiments of the present disclosure or the technical solutions in the prior art, the drawings required in the descriptions of the embodiments or of the prior art will be briefly introduced below. Obviously, the drawings in the following descriptions just illustrate some embodiments of the present disclosure, and other drawings can be obtained by those of ordinary skills in the art according to these drawings without paying creative labor.

Names of corresponding parts denoted with numbers and letters in the drawings.

Figure 1:
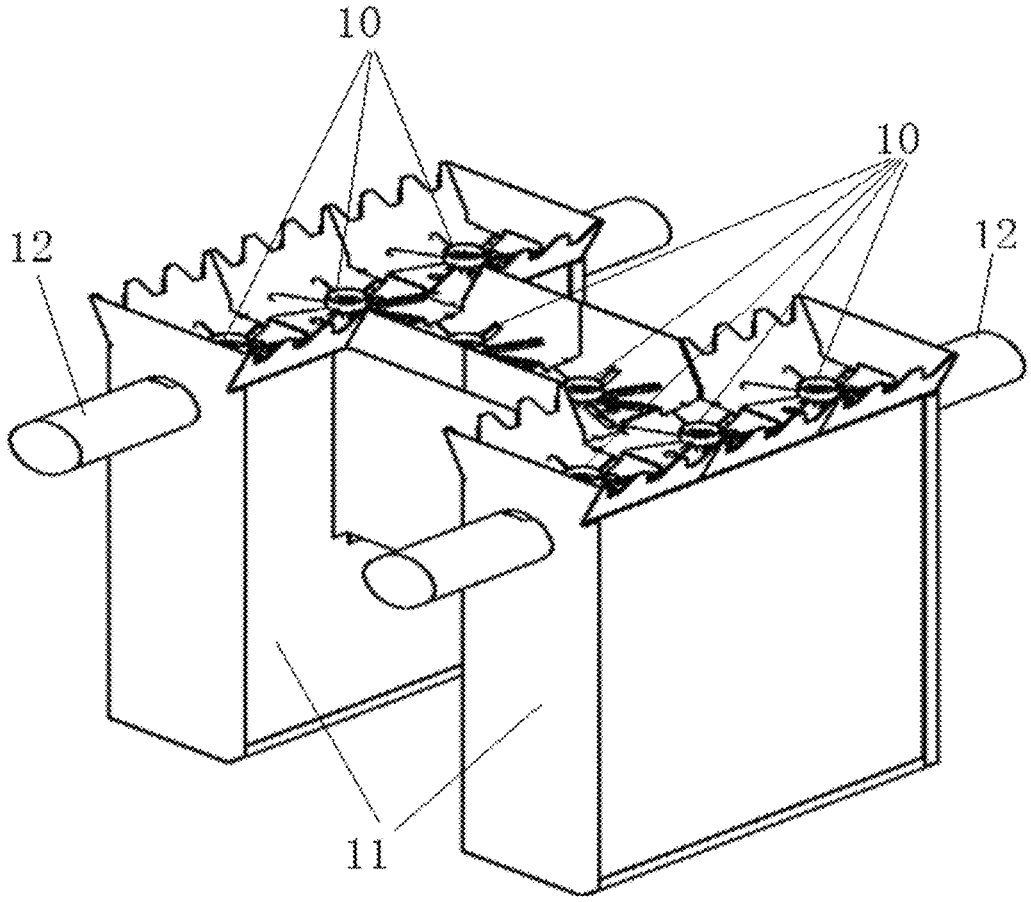
FIG. 1 is a schematic structural diagram of an embodiment of the present disclosure.

10—burner unit; 11—combustion air duct; 111—flow equalizing plate; 12—fuel gas supply pipeline; 121—first fuel gas opening; 122—second fuel gas opening; 13—combustion nozzle; 131—nozzle; 1311—small hole—diameter portion; 1312—large hole—diameter portion; 1313—groove; 1314—second through hole; 1315—induction ring body; 1316—air guide slope; 132—flame retaining cup; 1321—third through hole; 133—flame retaining cup base; 1331—first through hole; 14—fire protection baffle; 141—fin; 1411—notch; 142—base plate; 143—elongated hole; 144—air guide blade.

DETAILED DESCRIPTION OF THE PREFERRED EMBODIMENTS

The technical solutions in the embodiments of the present disclosure will be described clearly and completely with reference to the drawings in the embodiments of the present disclosure. Obviously, those described are only a part, rather than all, of the embodiments of the present disclosure. Based on the embodiments of the present disclosure, any other embodiment obtained by persons of ordinary skills in the art without paying creative labor should fall within the protection scope of the present disclosure.

As illustrated in FIGS. 1 to 6, one embodiment of the present disclosure is a low $NO_X$ air heating swirl burner, comprising at least one burner unit 10, that comprises:

- a combustion air duct 11 for providing combustion air and connected to a combustion fan through a pipeline;
- a fuel gas supply pipeline 12 for supplying gaseous fuel;
- a combustion nozzle 13 disposed at an air outlet of the combustion air duct 11 and connected to the fuel gas supply pipeline 12;
- a fire protection baffle 14 that covers the air outlet of the combustion air duct 11, and comprises a fin 141 and a base plate 142 for generating swirl combustion air; the combustion nozzle 13 is mounted at a center of the base plate 142, and a gas outlet of the combustion nozzle 13 is located on an air outlet side of the base plate 142; the base plate 142 is provided with a plurality of elongated holes 143 and air guide blades 144 disposed obliquely on air outlet sides of the elongated holes 143; the plurality of elongated holes 143 are distributed in a circumferential array by taking a center of the combustion nozzle 13 as a circle center, and a length of each of the elongated holes 143 is distributed in a radial direction or diagonally extended from an end near the circle center to an end away from the circle center; the fin 141 is extended obliquely outward from an edge of the base plate 142 in an outward expanding manner along an air outlet direction.

The above technical solution has the following advantageous effects: the combustion air flows out of the elongated holes in the base plate of the fire protection baffle, generates a rotational flow under the action of the air guide blades to be strongly mixed with the fuel gas sprayed from the combustion nozzle for combustion, and dissipates the high-temperature flame in a short time; a part of process air (the process air mentioned here means that a medium is used to absorb the heat generated by a burner, and then the heated medium is used to heat a products, such as drying a gypsum board) passes through the fin and participates in the combustion together with the combustion air, which greatly improves the temperature uniformity on the whole section of the combustion air duct, reduces the chemical combination of oxygen and nitrogen at a high temperature during combustion, greatly reduces the generation of nitrogen oxides, thus stably providing the heating process air with a uniform temperature below 850° C., and meeting the industrial technological requirements such as gypsum board drying. The burner is in a modular form, which can adopt a corresponding splicing shape according to structural features of a heating space to meet the heating requirement.

Figure 3:
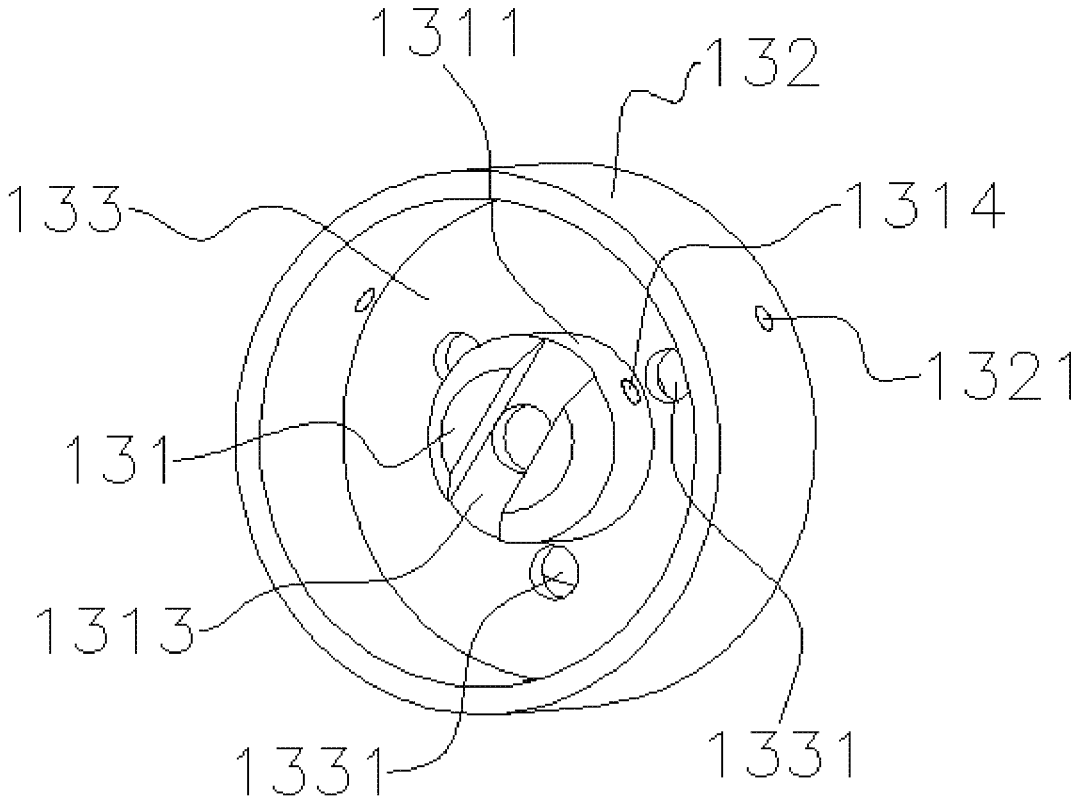
FIG. 3 is a schematic structural diagram of a combustion nozzle.

As shown in FIG. 3, in other embodiments of the present disclosure, the combustion nozzle 13 comprises a nozzle 131, a cylindrical flame retaining cup 132, and a flame retaining cup base 133 extended from an outer wall of the nozzle 131 to an inner wall of the flame retaining cup 132. The above technical solution has the advantageous effect of improving the flame stability.

Figure 4:
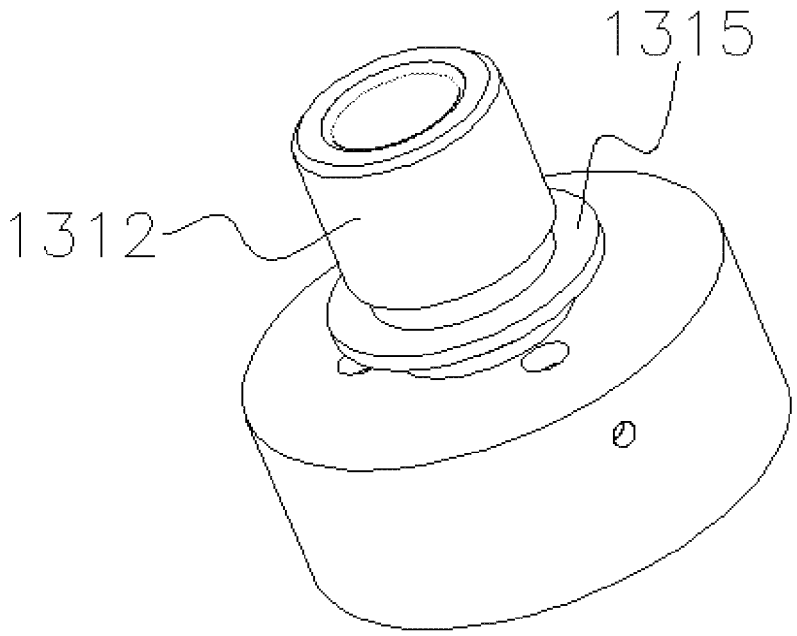
FIG. 4 is a schematic structural diagram of a combustion nozzle.
Figure 5:
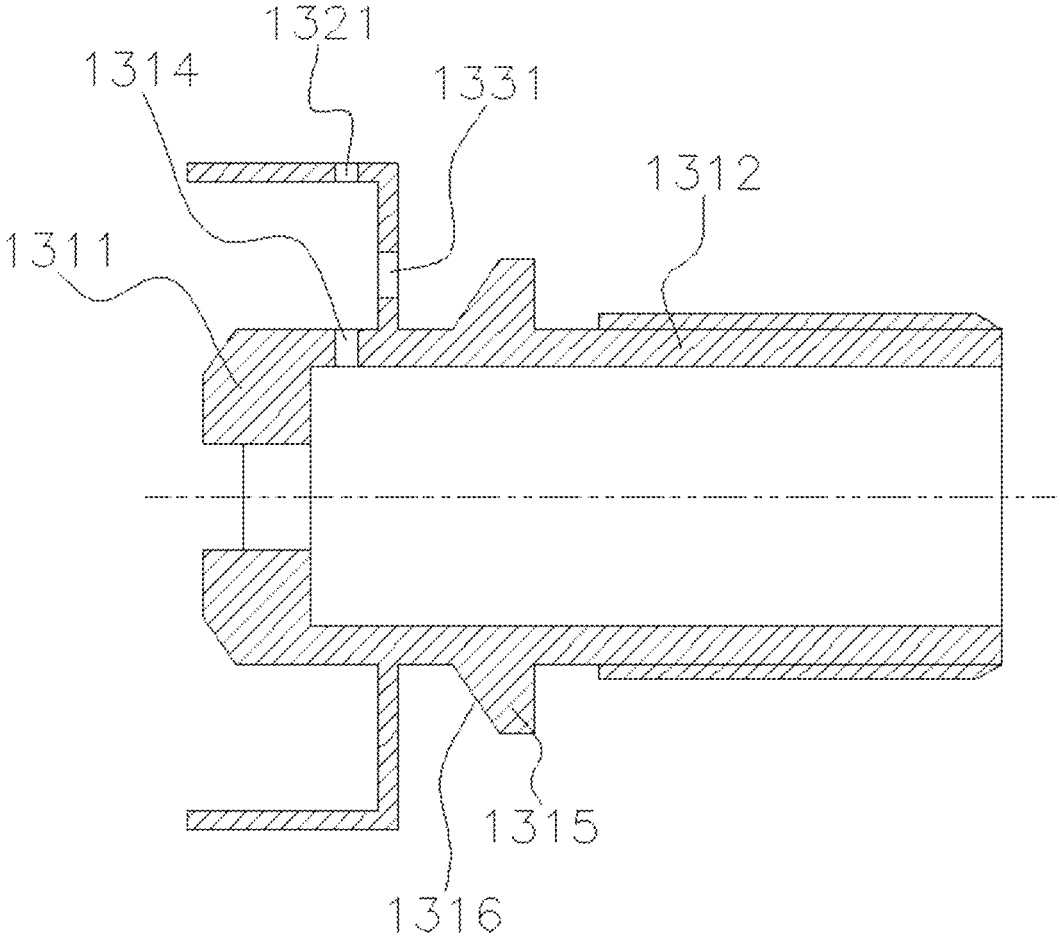
FIG. 5 is a sectional view of a combustion nozzle.

As shown in FIGS. 3 to 5, in other embodiments of the present disclosure, the nozzle 131 comprises a small hole-diameter portion 1311 at a head end thereof and a large hole-diameter portion 1312 communicated with the small hole-diameter portion 1311; a diameter of a central vent hole of the large hole-diameter portion 1312 is larger than that of a central vent hole of the small hole-diameter portion 1311; an end face of the head end of the nozzle 131 is provided with a concave groove 1313, and two side walls of the groove are along two parallel tangent lines of the central vent hole of the small hole-diameter portion 1311; and two ends of the groove 1313 are disposed to penetrate through an outer wall of the top of the nozzle. An outer periphery of a rear segment of the large hole-diameter portion 1312 of the nozzle is provided with external threads for threaded-connection with the fuel gas supply pipeline 12; a small center hole in a head of the nozzle ensures that the fuel gas can be sprayed from the nozzle at a high speed; and the walls of the groove can protect the flame.

As shown in FIGS. 3 to 5, in other embodiments of the present disclosure, the small hole-diameter portion 1311 of the nozzle 131 is completely located on a flame generation side of the flame retaining cup base 133, and the large hole-diameter portion 1312 of the nozzle 131 also has a part of primary structure located on the flame generation side of the flame retaining cup base 133; the flame retaining cup base 133 is provided with a plurality of first through holes 1331 which are distributed in a circumferential array by taking a center of the nozzle as a circle center, and a pipe wall of the large hole-diameter portion located on the flame generation side of the flame retaining cup base 131 is provided with a plurality of second through holes 1314 extended in a radial direction and of the same number as the first through holes 1331; in each pair of the first through hole 1331 and the second through hole 1314, an axis of the first through hole 1331 and a circle center of the second through hole 1314 are coincided on a projection plane along an axis direction of the nozzle. The above technical solution has the advantageous effects that the first through holes on the flame retaining cup base facilitate a part of combustion air to reach an inner side of the flame retaining cup, while the second through holes in the circumferential direction of the head of the nozzle facilitate the fuel gas to laterally overflow from the nozzle, and the part of combustion air is premixed with the overflowed fuel gas, thus improving the combustion sufficiency.

As shown in FIGS. 4 to 5, in other embodiments of the present disclosure, the outer wall of the large hole-diameter portion 1312 of the nozzle 131 is further provided with an outwardly extended induction ring body 1315, which is located between the flame retaining cup base 133 of the combustion nozzle and the base plate 142 of the fire protection baffle, and is provided with an air guide slope 1316 that faces towards the first through hole. The above technical solution has the advantageous effects that the air guide slope improves the smoothness of guiding the combustion air to an inner side of the flame retaining cup, and the induction ring body can also play a limiting role when the combustion nozzle is mounted, thus ensuring an accurate mounting position of the combustion nozzle.

As shown in FIG. 3, in other embodiments of the present disclosure, a plurality of third through holes 1321 are disposed on the flame retaining cup 132; the number of the first through holes 1331 or the second through holes 1314 is 3 to 6, and the number of the third through holes 1321 is 3 to 12. The above technical solution has the advantageous effect that the third through holes facilitate the overflow of the mixture of the fuel gas and air in the flame retaining cup, thus transferring the flame and improving the flame stability.

Figure 2:
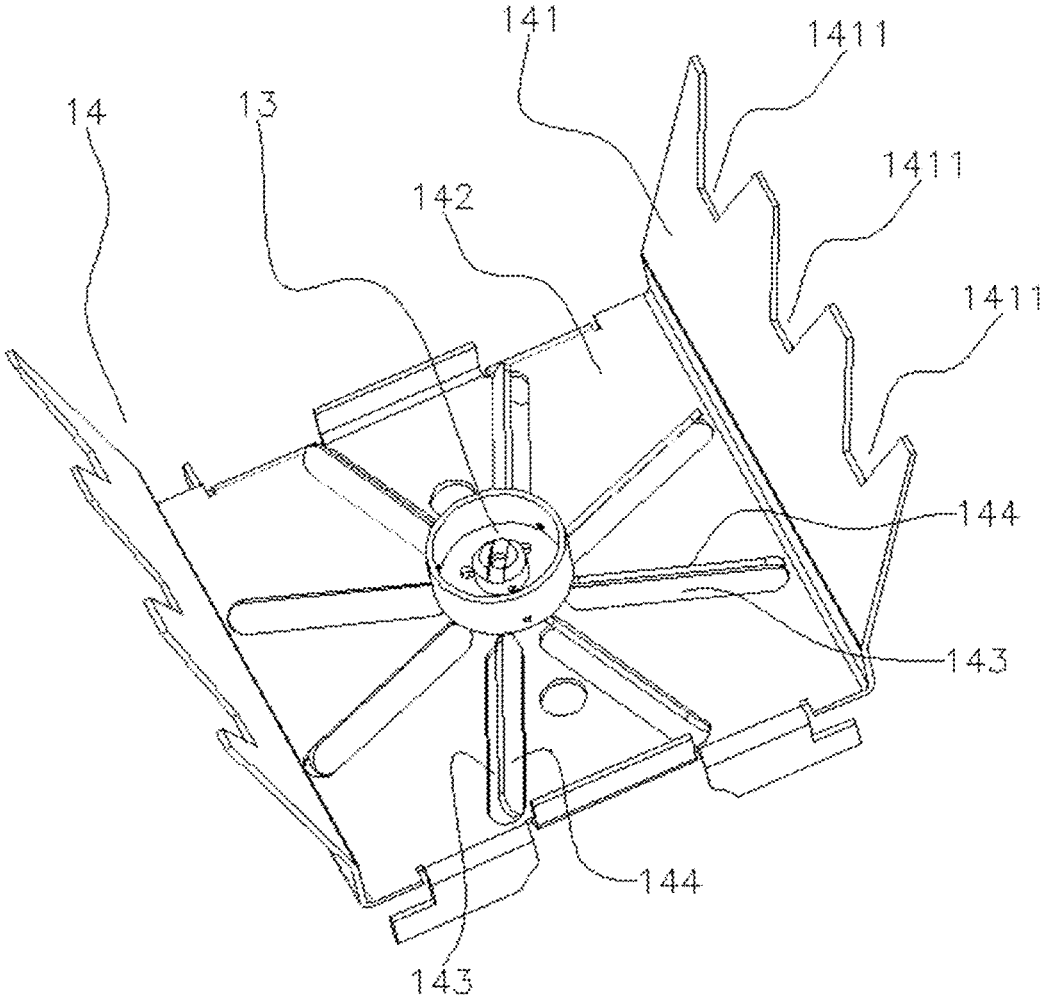
FIG. 2 is a schematic structural diagram of a combination of a combustion nozzle and a fire protection baffle.

As shown in FIG. 2, in other embodiments of the present disclosure, an included angle between the fin 141 and the base plate 142 of the fire protection baffle 14 is 20° to 60°; a notch 1411 is formed at an outer edge of the fin 141, and an opening width of the notch 1411 gradually increases from an inner side to an outer side. The above technical solution has the advantageous effects that the process air can reach an inner side of the fin along the notch to support the flame and generate more uniform temperatures in the whole air duct plane.

As shown in FIG. 2, in other embodiments of the present disclosure, the number of the elongated holes 143 in the base plate 142 of the fire protection baffle is 4 to 12, and an inclined angle between the air guide blade and the base plate is 30° to 60°. The above technical solution has the advantageous effect that it is convenient to cause a strong rotation of the combustion air, enhance the mixing with the fuel gas, and shorten the flame.

Figure 6:
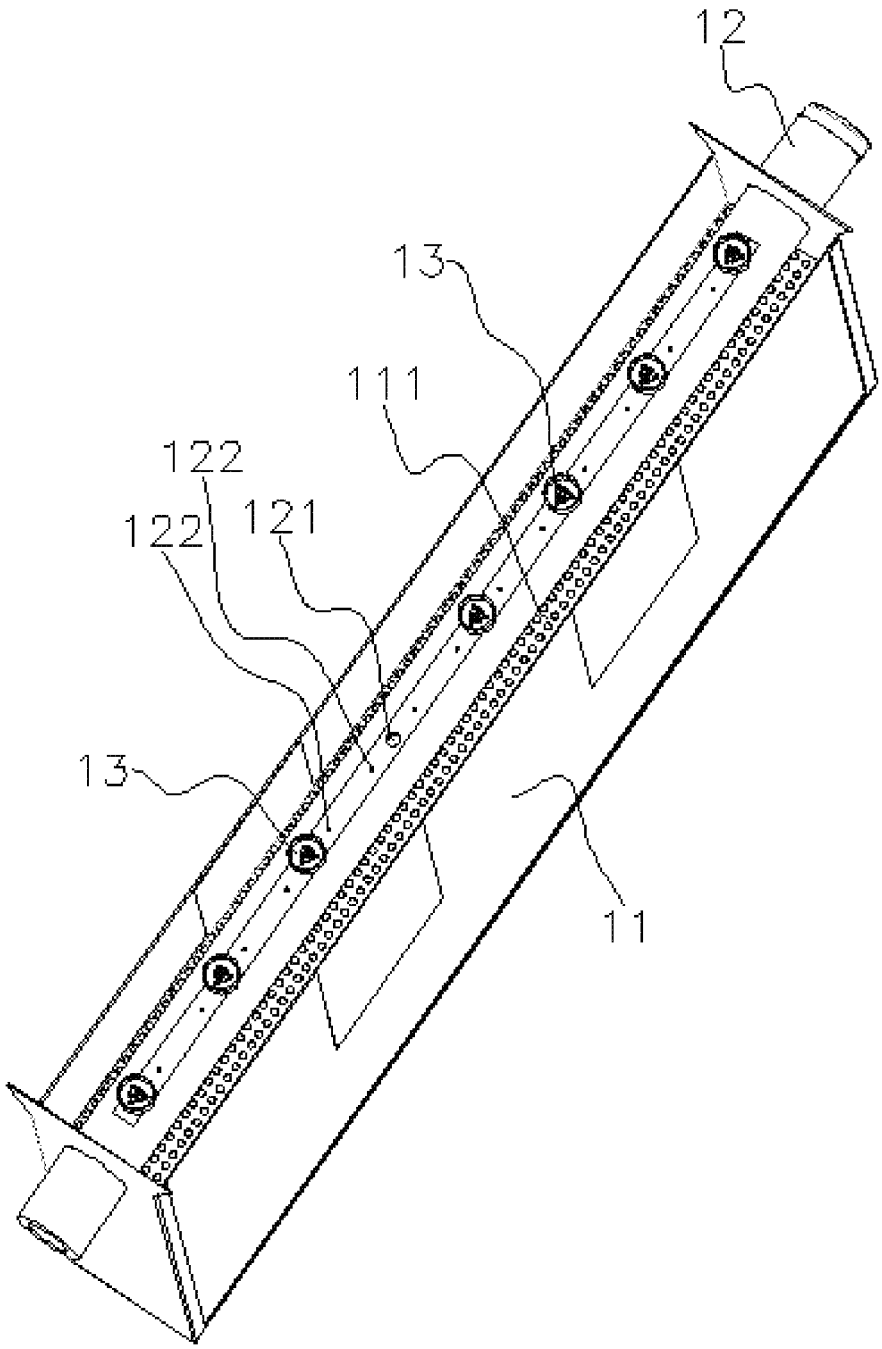
FIG. 6 is a partial schematic diagram of a burner with a fire protection baffle hidden.

As shown in FIG. 6, in other embodiments of the present disclosure, a flow equalization plate 111 is disposed in the combustion air duct 11 and provided with densely distributed small holes. The above technical solution has the advantageous effect that the flow equalization plate can equalize the combustion air from the air duct and uniformly distribute the combustion air to the space of each burner unit.

As shown in FIG. 6, in other embodiments of the present disclosure, the number of the burner units is greater than or equal to 2, and the fuel gas supply pipeline 12 is distributed along connecting lines between centers of the combustion nozzles 13 of the burner units; the fuel gas supply pipeline 12 is provided with first fuel gas openings 121 for mounting the combustion nozzles, and second fuel gas openings 122 connected between the adjacent first fuel gas openings; a diameter of the first fuel gas opening 121 is larger than that of the second fuel gas opening 122; the number of the second fuel gas openings 122 distributed between adjacent two of the first fuel gas openings 121 is 1 to 3; and the diameter of the second fuel gas opening 122 is 1 to 4 mm. The above technical solution has the advantageous effect that the fuel gas reaches an inner side of the fire protection baffle through the second fuel gas openings, and is mixed with air to generate a flame, which is beneficial to the propagation of the flame among the burner units and causes the temperatures of the whole section of the hot air duct to be more uniform.

Figure 7:
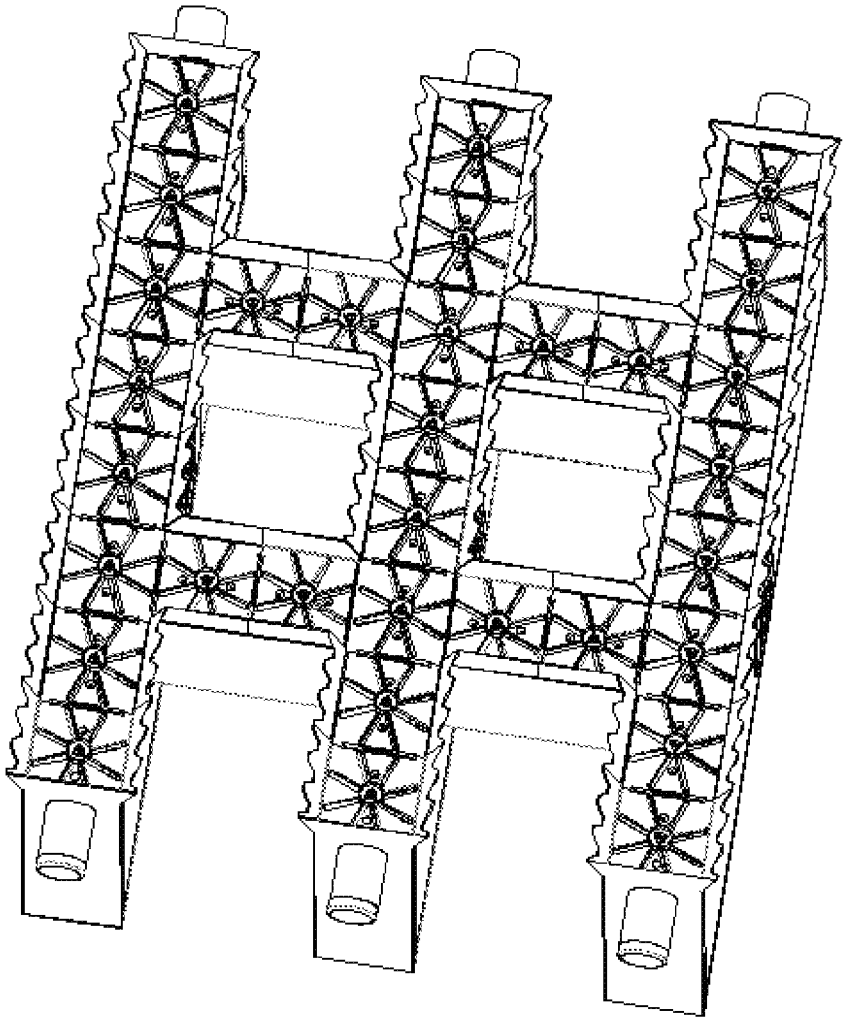
FIG. 7 is a schematic structural diagram of another embodiment of the present disclosure.

As shown in FIG. 7, in other embodiments of the present disclosure, the plurality of burner units are spliced into a grid, the fins of the fire protection baffles are distributed at edges of an outline of a base plate of the grid, and a distance between adjacent two of the fire protection baffles is 1.5 to 4 times a width of a single fire protection baffle. The above technical solution has the advantageous effect that the number of the burner units is reduced so that the layout of the burner units is more reasonable, and it is convenient to provide a large cross section of the hot air duct and hot air of uniform temperatures thereon.

The above embodiments are only given to explain the technical concepts and characteristics of the present disclosure, for the purpose of enabling persons of ordinary skills in the art to understand and implement the present disclosure, rather than limiting the protection scope thereof. Any equivalent change or modification made according to the spiritual essence of the present disclosure should be covered in the protection scope of the present disclosure.

The invention claimed is:

1. A low $NO_X$ air heating swirl burner, comprising at least one burner unit, the at least one burner unit comprising:

a combustion air duct for providing combustion air and connected to a combustion fan through a duct;

a fuel gas supply pipeline for supplying gaseous fuel;

a combustion nozzle disposed at an air outlet of the combustion air duct and connected to the fuel gas supply pipeline;

a fire protection baffle that covers the air outlet of the combustion air duct, and comprises a fin and a base plate for generating swirl combustion air; the combustion nozzle is mounted at a center of the base plate, and a gas outlet of the combustion nozzle is located on an air outlet side of the base plate; the base plate is provided with a plurality of elongated holes and air guide blades disposed obliquely on air outlet sides of the elongated holes; the plurality of elongated holes are distributed in a circumferential array by taking a center of the combustion nozzle as a circle center, and a length of each of the elongated holes is distributed in a radial direction or diagonally extended from an end near the circle center to an end away from the circle center; the fin is extended obliquely outward from an edge of the base plate in an outward expanding manner along an air outlet direction, wherein the combustion nozzle comprises a nozzle, a cylindrical flame retaining cup, and a flame retaining cup base extended from an outer wall of the nozzle to an inner wall of the flame retaining cup, and wherein the nozzle comprises a small hole-diameter portion at a head end thereof and a large hole-diameter portion communicated with the small hole-diameter portion; a diameter of a vent hole of the large hole-diameter portion is larger than that of a vent hole of the small hole-diameter portion; an end face of the head end of the nozzle is provided with a concave groove, and two side walls of the groove are along two parallel tangent lines of the vent hole of the small hole-diameter portion; and two ends of the groove are disposed to penetrate through an outer wall of a top of the nozzle.

2. The low $NO_X$ air heating swirl burner according to claim 1, wherein the small hole-diameter portion of the nozzle is completely located on a flame generation side of the flame retaining cup base, and the large hole-diameter portion of the nozzle also has a part of primary structure located on the flame generation side of the flame retaining cup base; the flame retaining cup base is provided with a plurality of first through holes which are distributed in a circumferential array by taking a center of the nozzle as a circle center, and a pipe wall of the large hole-diameter portion located on the flame generation side of the flame retaining cup base is provided with a plurality of second through holes extended in a radial direction thereof and of the same number as the first through holes; in each pair of the first through hole and the second through hole, an axis of the first through hole and a circle center of the second through hole are coincided on a projection plane along an axis direction of the nozzle.

3. The low $NO_X$ air heating swirl burner according to claim 2, wherein the outer wall of the large hole-diameter portion of the nozzle is further provided with an outwardly extended induction ring body, which is located between the flame retaining cup base of the combustion nozzle and the base plate of the fire protection baffle, and is provided with an air guide slope that faces toward the first through hole.

4. The low $NO_X$ air heating swirl burner according to claim 2, wherein a plurality of third through holes are disposed on the flame retaining cup; the number of the first through holes or the second through holes is 3 to 6, and the number of the third through holes is 3 to 12.

5. The low $NO_X$ air heating swirl burner according to claim 1, wherein an included angle between the fin and the base plate of the fire protection baffle is 20° to 60°; a notch is formed at an outer edge of the fin, and an opening width of the notch gradually increases from an inner side to an outer side.

6. The low $NO_X$ air heating swirl burner according to claim 1, wherein the number of the elongated holes in the base plate of the fire protection baffle is 4 to 12, and an inclined angle between the air guide blade and the base plate is 30° to 60°.

7. The low $NO_X$ air heating swirl burner according to claim 1, wherein a flow equalization plate is disposed in the combustion air duct and provided with densely distributed small holes.

8. The low $NO_X$ air heating swirl burner according to claim 1, wherein the number of the burner units is greater than or equal to 2, and the fuel gas supply pipeline is distributed along connecting lines between centers of the combustion nozzles of the burner units; the fuel gas supply pipeline is provided with first fuel gas openings for mounting the combustion nozzles, and second fuel gas openings connected between the adjacent first fuel gas openings; a diameter of the first fuel gas opening is larger than that of the second fuel gas opening; the number of the second fuel gas openings distributed between adjacent two of the first fuel gas openings is 1 to 3; the diameter of the second fuel gas opening is 1 to 4 mm; the base plate of the fire protection baffle is provided with through holes for releasing fuel gas flowing from the second fuel gas openings.

9. The low $NO_X$ air heating swirl burner according to claim 8, wherein the plurality of burner units are spliced into a grid, the fins of the fire protection baffles are distributed at edges of an outline of a base plate of the grid, and a distance between adjacent two of the fire protection baffles is 1.5 to 4 times a width of a single fire protection baffle.

* * * * *